US009469387B2

(12) United States Patent
Pajonk-Taylor et al.

(10) Patent No.: US 9,469,387 B2
(45) Date of Patent: Oct. 18, 2016

(54) SELECTIVELY USABLE BUOY AND WATER-FILLED PUNCHING BAG AND KIT

(71) Applicant: Taylor Made Group, LLC, Gloversville, NY (US)

(72) Inventors: Jason Pajonk-Taylor, Saratoga Springs, NY (US); Edwin Rivera, East Northport, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 54 days.

(21) Appl. No.: 14/455,004

(22) Filed: Aug. 8, 2014

(65) Prior Publication Data

US 2016/0039502 A1 Feb. 11, 2016

(51) Int. Cl.

| | |
|---|---|
| ***A63B 69/34*** | (2006.01) |
| ***B63B 59/02*** | (2006.01) |
| ***A63B 69/20*** | (2006.01) |

(52) U.S. Cl.

CPC ..... *B63B 59/02* (2013.01); *A63B 69/201* (2013.01)

(58) Field of Classification Search

CPC ..... A63B 41/00; A63B 41/02; A63B 41/04; A63B 41/12; A63B 69/20; A63B 69/201; A63B 69/203; A63B 69/205; A63B 69/208; A63B 69/24; A63B 69/26; A63B 69/32; A63B 69/325; A63B 69/34; A63B 69/345; A63B 2225/60; A63B 2225/605; A63B 2225/62; B63B 59/02; B63B 2059/025

USPC ..... 482/83–90

See application file for complete search history.

(56) References Cited

U.S. PATENT DOCUMENTS

| | | | | |
|---|---|---|---|---|
| 3,397,887 | A * | 8/1968 | Caplan | A63B 43/007 114/123 |
| 4,121,829 | A * | 10/1978 | Petrusek | A63B 69/0086 473/576 |
| 4,527,796 | A | 7/1985 | Critelli | |
| 4,875,427 | A * | 10/1989 | Harris, Jr. | B63B 59/02 114/219 |
| 6,558,298 | B2 | 5/2003 | Fields et al. | |
| 2002/0094917 | A1 | 7/2002 | Wang | |
| 2002/0115538 | A1* | 8/2002 | Wen | A63B 69/34 482/83 |
| 2003/0144096 | A1* | 7/2003 | Lee | A63B 41/04 473/611 |
| 2006/0166793 | A1 | 7/2006 | Gobel et al. | |
| 2007/0072747 | A1* | 3/2007 | Jaet | A63B 69/004 482/83 |
| 2007/0099772 | A1 | 5/2007 | Fu et al. | |
| 2007/0199502 | A1* | 8/2007 | Bifulco | B63C 11/26 116/210 |
| 2008/0096733 | A1 | 4/2008 | Epstein | |
| 2010/0210426 | A1 | 8/2010 | Styopin et al. | |
| 2011/0281696 | A1* | 11/2011 | Cuadrado | A63B 69/205 482/87 |
| 2012/0157269 | A1 | 6/2012 | Fu et al. | |
| 2015/0211602 | A1* | 7/2015 | Beyer-Olsen | F16G 11/00 114/219 |

FOREIGN PATENT DOCUMENTS

| | | |
|---|---|---|
| GB | 261614 | 11/1926 |
| GB | 2 372 712 | 9/2002 |
| JP | 3173948 | 2/2012 |

* cited by examiner

*Primary Examiner* — Oren Ginsberg
*Assistant Examiner* — Gary D Urbiel Goldner
(74) *Attorney, Agent, or Firm* — Nixon & Vanderhye P.C.

(57) ABSTRACT

An inflatable bag is selectively usable as one of a buoy and a punching bag. The inflatable bag is inflated depending on the selected use, and the inflating is practiced differently depending on the use decision. When it is decided to use the bag as a punching bag, the bag is suspended, and the bag is inflated with water. An inflatable bag member and kit includes components suitable for the selected use.

5 Claims, 2 Drawing Sheets

SELECTIVELY USABLE BUOY AND WATER-FILLED PUNCHING BAG AND KIT

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates generally to an inflatable bag and, more particularly, to the selective use of an inflatable bag as a buoy and a water-filled punching bag.

An exemplary use for inflatable buoys is to protect a boat from impact with a dock or other boats or obstacles and vice versa. The inflatable buoy can be suspended from a boat side or secured directly to the dock. For use in the marine environment, the buoys are filled with air to provide for flotation when used in water.

BRIEF SUMMARY OF THE INVENTION

An inflatable bag is selectively usable as one of a buoy and a punching bag. The inflatable bag is inflated depending on the selected use, and the inflating is practiced differently depending on the use decision. When it is decided to use the bag as a punching bag, the bag is suspended, and the bag is inflated with water. An inflatable bag member and kit includes components suitable for the selected use.

In an exemplary embodiment, a method of using an inflatable bag includes the steps of (a) selectively inflating the inflatable bag with one of water and air; (b) when step (a) is practiced by inflating with air, securing the inflated bag on a boat for use as a buoy; and (c) when step (a) is practiced by inflating with water, suspending the bag for use as a punching bag. The inflatable bag may include a support opening, wherein when step (a) is practiced by inflating with water, the method may further comprise (d) attaching a shackle to the support opening; (e) securing a hanging support hook to the shackle; (f) suspending the bag using the hanging support hook; and (g) filling the inflatable bag with water. Step (f) may be practiced before step (g). The inflatable bag may include a plug, wherein the method may comprise, before step (g), the step of removing the plug, and after step (g), the step of replacing the plug. Step (g) may be practiced by attaching an adapter to a water hose, and securing the adapter to the inflatable bag.

In another exemplary embodiment, an inflatable member and kit is selectively usable as a buoy and as a punching bag. The inflatable member and kit include an inflatable bag including a support opening and being selectively inflatable with one of water and air, a shackle attachable to the support opening, a hanging support hook securable to the shackle, and a hose adapter sized corresponding to and being cooperable with a fluid opening in the inflatable bag. The hanging support hook may include an S-hook or a quick link. The kit may also include a removable plug closing the fluid opening. The kit may also include a bolt for securing the shackle to the support opening. The inflatable bag may be constructed of vinyl. The support opening may be a rope eye. The inflatable bag may be teardrop shaped.

In yet another exemplary embodiment, a method includes the steps of (a) providing an inflatable bag; (b) deciding to use the inflatable bag as one of a buoy and a punching bag; (c) selectively inflating the inflatable bag according to the decision in step (b), wherein step (c) is practiced differently depending on the decision in step (b); and (d) when the decision in step (b) is to use the inflatable bag as a punching bag, step (c) is practiced by suspending the bag, and inflating the bag with water.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
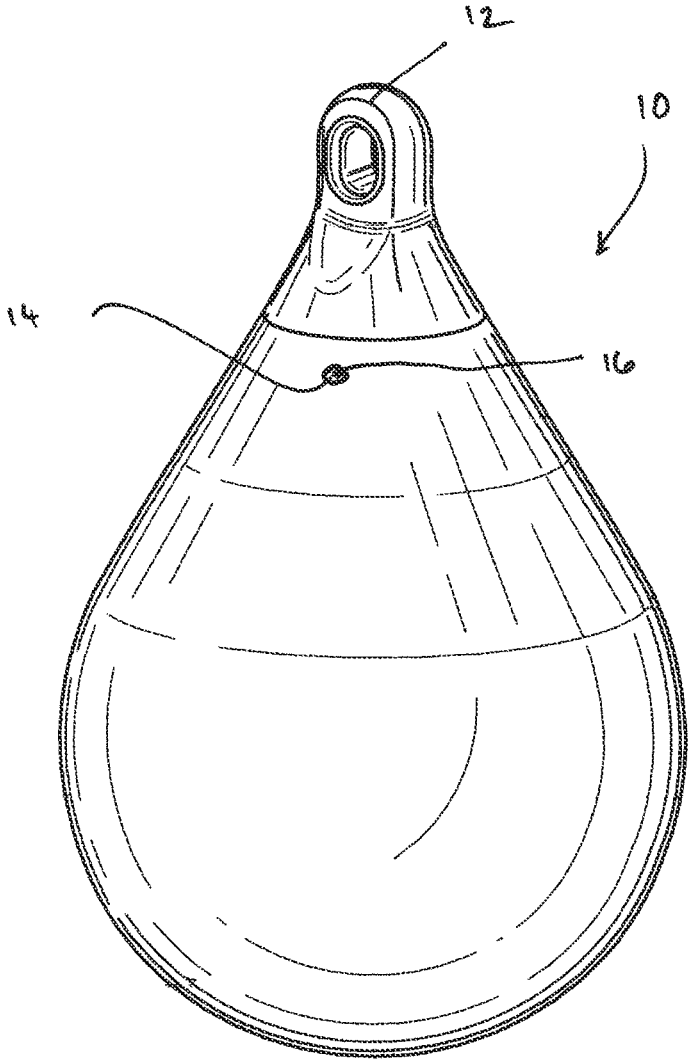
FIG. 1 is a perspective view of the inflatable bag.
Figure 2:
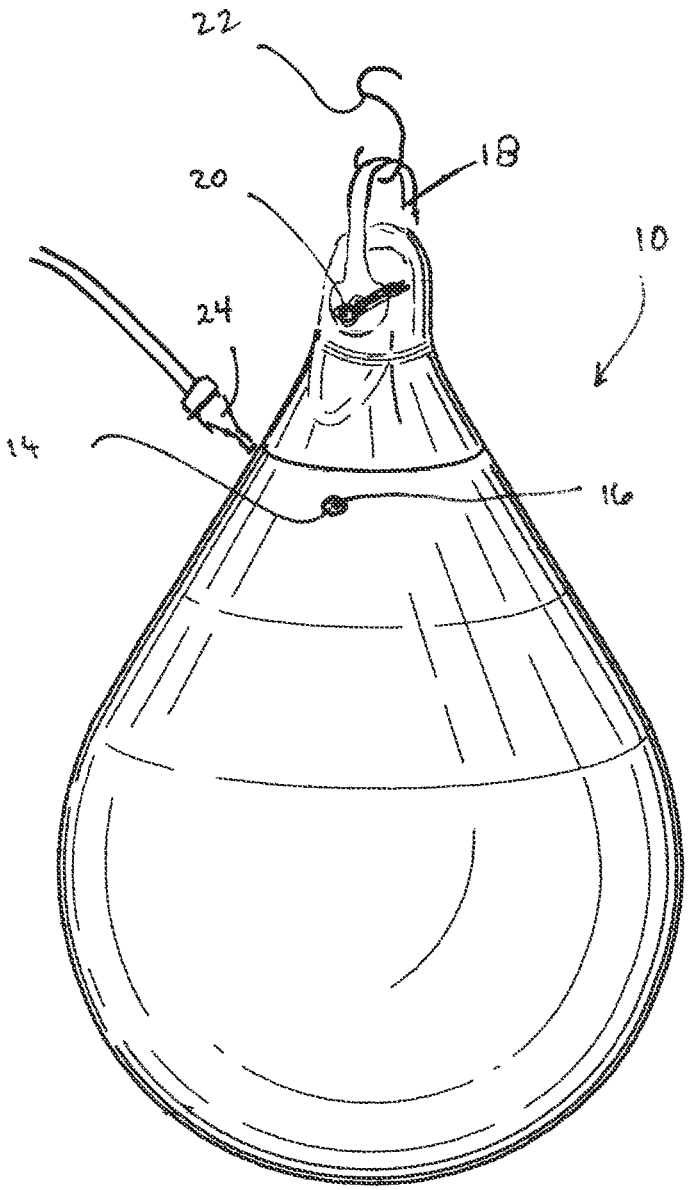
FIG. 2 shows the inflatable bag including the components of a kit.

With reference to the drawings, the inflatable bag 10 is generally formed in a tear drop shape with rope eye 12 at a top end and a valve opening 14 sealed closed with a plug 16. In an exemplary embodiment, the inflatable bag 10 is injection molded vinyl and comprises a seamless construction.

According to preferred embodiments, the inflatable bag 10 is part of an inflatable member and kit that is selectively usable as a buoy and as a water-filled punching bag. The inflatable bag 10 is selectively inflatable with one of water and air. A shackle 18 is attachable to a support opening 12 (such as a rope eye) via a bolt 20 or the like, and a hanging support hook 22 is securable to the shackle 18. The support hook 22 may be an S-hook or a quick link or other suitable connector. The kit also includes a hose adapter 24 that is sized corresponding to and cooperable with the valve opening 14 in the inflatable bag 10.

When it is desired to use the inflatable bag 10 as a buoy, the inflatable bag is inflated with air, and the inflated bag is securable on a boat, dock or the like for use as a buoy.

When it is desired to utilize the inflatable bag as a water-filled punching bag, the inflatable bag is inflated with water, and the bag is suspended for use as the punching bag. In order to install the inflatable bag for use as a punching bag, the shackle 18 is first attached to the support opening 12. The hanging support hook 22 is secured to the shackle, and the bag is suspended from suitable support structure using the hanging support hook 22. It is desirable to hang the bag before filling it with water as the bag is much more difficult to handle once filled with water.

With the hose adapter 24 secured to a water hose, the plug 16 is removed from the valve opening 14, and the hose adapter 24 is inserted into the valve opening 14. The inflatable bag 10 is subsequently filled with water, and when filled, the hose adapter 24 is removed, and the plug 16 is replaced.

The invention provides for the selective use of an inflatable bag as a buoy or a water-filled punching bag. The inflating is practiced differently depending on the use decision. An inflatable bag member and kit includes components suitable for the selected use.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of using an inflatable bag, the method comprising:

(a) selectively inflating the inflatable bag with one of water and air;

(b) when step (a) is practiced by inflating with air, the method consists of securing the inflatable bag on a boat for use as a buoy; and (c) when step (a) is practiced by inflating with water, the method consists of utilizing the inflatable bag as a punching bag, the method further comprising suspending the inflatable bag for use as the punching bag.

2. The method according to claim 1, wherein the inflatable bag includes a support opening, and wherein the step of utilizing the inflatable bag as the punching bag further comprises:

(d) attaching a shackle to the support opening;

(e) securing a hanging support hook to the shackle;

(f) suspending the bag using the hanging support hook; and (g) filling the inflatable bag with water.

3. The method according to claim 2, wherein step (f) is practiced before step (g).

4. The method according to claim 2, wherein the inflatable bag includes a plug, and wherein the method comprises, before step (g), the step of removing the plug, and after step (g), the step of replacing the plug.

5. The method according to claim 2, wherein step (g) is practiced by attaching an adapter to a water hose, and securing the adapter to the inflatable bag.

* * * * *